United States Patent [19]

Mrdjenovich

[11] 3,985,546

[45] Oct. 12, 1976

[54] METHOD OF FLUIDIZING ACID CUPOLA SLAG

[75] Inventor: Robert Mrdjenovich, Trenton, Mich.

[73] Assignee: Ford Motor Company, Dearborn, Mich.

[22] Filed: Dec. 23, 1974

[21] Appl. No.: 535,546

[52] U.S. Cl. ..... 75/30; 75/43; 75/94

[51] Int. Cl.[2] ..... C21B 5/04

[58] Field of Search ..... 75/30, 94, 43, 44, 130, 75/55, 53, 54, 56, 57, 58

[56] References Cited

UNITED STATES PATENTS

| | | | |
|---|---|---|---|
| 1,743,885 | 1/1930 | Gardner | 75/30 |
| 3,702,182 | 11/1972 | Leyshon | 75/43 |
| 3,721,547 | 3/1973 | Dvorak et al. | 75/43 |

FOREIGN PATENTS OR APPLICATIONS

| | | | |
|---|---|---|---|
| 579,018 | 7/1959 | Canada | 75/30 |

*Primary Examiner*—M. J. Andrews
*Attorney, Agent, or Firm*—Joseph W. Malleck; Keith L. Zerschling

[57] ABSTRACT

A composition and method is disclosed for fluxing and fluidizing the slag in an acid-operated cupola, the method comprising adding to the charge therein a fluxing material effective to provide, by weight analysis of the slag, 30–42% CaO, 41–44% $SiO_2$, 7–15% $Al_2O_3$, 0.5–4.0 $TiO_2$, 1.6–3.2% MnO, less than 0.05% $P_2O_5$ and less than 1% sulfur. A fluxing composition is disclosed which is comprised by weight percentage of the metal charge comprising, when used with a limestone or a dolomitic limestone charge: 1.5–3.5% limestone or dolomitic limestone, 0.5–1.5% FeO . $Fe_2O_3$ . $TiO_2$.

4 Claims, 1 Drawing Figure

| | CaO | $CaF_2$ | $SiO_2$ | $Al_2O_3$ | MgO | MnO | $P_2O_5$ | Contained Fe | S |
|---|---|---|---|---|---|---|---|---|---|
| Std. (Standard) | 60.0% | 0% | 30.0% | 6.5% | 7.0% | .36% | .38% | .33% | 1.20% |
| Mod. (Modified) | 52.0% | 0% | 31.0% | 6.5% | 14.9% | .45% | .24% | .36% | 1.05% |

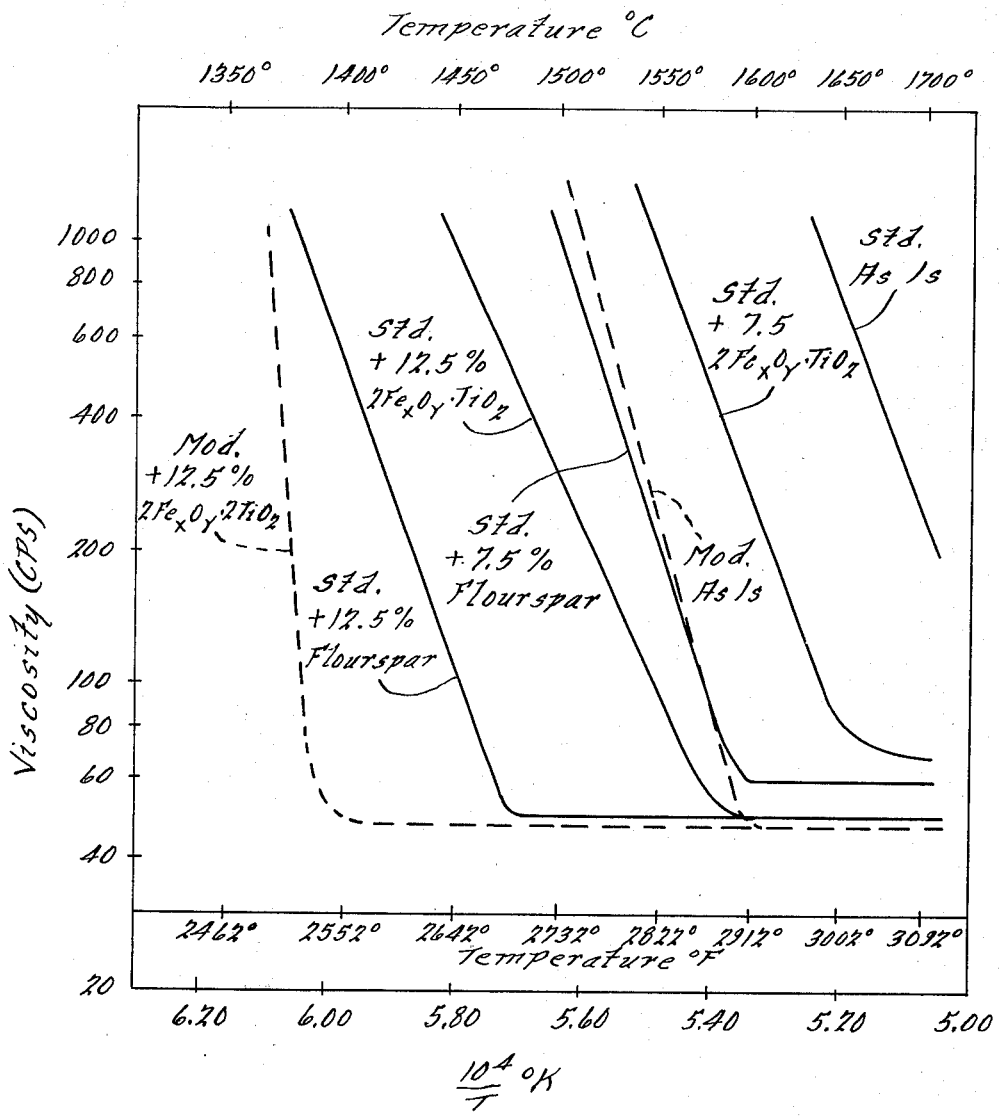
| | CaO | $CaF_2$ | $SiO_2$ | $Al_2O_3$ | MgO | MnO | $P_2O_5$ | Contained Fe | S |
|---|---|---|---|---|---|---|---|---|---|
| Std. (Standard) | 60.0% | 0% | 30.0% | 6.5% | 7.0% | .36% | .38% | .33% | 1.20% |
| Mod. (Modified) | 52.0% | 0% | 31.0% | 6.5% | 14.9% | .45% | .24% | .36% | 1.05% |

METHOD OF FLUIDIZING ACID CUPOLA SLAG

BACKGROUND OF THE INVENTION

The operation of cupolas with acid slags has, as its principal objective, the production of low cost irons. The acid cupola is used extensively for making grey cast iron; greater consistency of the charge materials reduces the risk of chemical variations within the metal produced. Nonetheless, there are certain problems associated with current acid operated cupolas. Although fluidity of the slag is generally adequate, there is the need for use of secondary or special fluxes and for this the prior art has traditionally turned to fluorspar. Fluorspar creates hydrofluoric acid, formed as a reaction gas in the cupola which deteriorates fiberglas-type bags utilized to collect residue and particles in the cupola effluent. Even those instances where the cupola does not require a bag house assessory, there is a problem in recycling the transport water used in the slag sluice for conveying the slag. Both iron and fluoride compounds can form on the shell of a water cooled cupola in which the cooling water is rendered acidic by fluoride ions. This coating of the shell limits heat transfer and can result in shell buckling and subsequent cost/operating problems. Fluorspar has become an extremely expensive material primarily because it is imported and is in high demand accompanied by relatively low supply. Accordingly, there is a need to achieve equivalent slag characteristics by the use of slag constituents that do not depend upon fluorspar.

There is still another need that is not satisfied by the use of fluorspar as a fluidizer in an acid-type slag composition and that is the requirement for achieving a good chill factor in the production of grey cast iron.

SUMMARY OF THE INVENTION

A primary object of this invention is to provide a fluxing and fluidizing additive utilizable in the production of grey iron in an acid operated cupola, the additive functions to (a) achieve equivalent fluidity to that of current practice while assisting to meet environmental controls concerning water and air, (b) substantially reduce the cost of the additive compared to present day practice, and (c) improve the chill factor for low carbon equivalent grey cast irons.

Another object of this invention is to provide a secondary fluxing composition useful in an acid-operated cupola which is effective to eliminate dependence upon fluorspar while reducing volume requirements for the fluidizing composition.

Another object of this invention is to provide a method of making grey cast iron which includes, in the make-up of the fluidizing additive for the slag, a titanium oxide compound in a significant amount which not only reduces substantially the cost of the fluidizing additive, but serves to, upon partial reversion to titanium, improve the chill factor of low carbon equivalent cast irons.

A particular feature pursuant to the above objects is the use of a fluxing composition containing, on a weight basis related to the total metal charge, the following: 1.5–3.5% limestone or dolomitic limestone, and 0.5–1% $FeO \cdot Fe_2O_3 \cdot TiO_2$.

SUMMARY OF THE DRAWING

The FIGURE is a graphical illustration of the variation of viscosity for fluxing compositions with temperature, the illustration comparing current practice compositions with some of the compositions incorporating the features of this invention.

DETAILED DESCRIPTION

Acid slags formed in the cupola are very similar to glass. Many consider glass as a supercooled liquid. However, these glassy slags or the common glass structure are vitreous in nature and when "solidified," they are more rigid than amorphous liquid structure because of a three dimensional network structure containing covalent and/or ionic bonding.

Glass formers are materials that possess the following characteristics:

a. chain structure formers
b. low co-ordination number
c. open-structured (not close packed)
d. directed valences Examples of glass formers are $SiO_2$ and $B_2O_3$.

With respect to acid slags or common silica glasses, the viscosity of the liquid material is controlled by the network of tetrahedral silica molecules. The material is rigid or viscous when this chained or network structure is continuous or non-interrupted. This rigid network structure can be disrupted, and hence become fluid or "plastic" by increasing temperature in which the energy from the thermal vibrations is sufficient to break the bonds, or by chemically breaking the $SiO_4$ bonds by addition of modifiers or non-glass formers. The modifiers, such as CaO, add oxygen to the $SiO_4$ tetrahedral structure which in essence destroys the bonds linking the $SiO_4$ structure. Non-glass formers, such as the ionic salts (NaCl, $CaCl_2$ $CaF_2$) function in a similar manner e.g. reaction with the $SiO_4$ bonds to destroy network structure. $TiO_2$ in ilmenite reacts in a manner similar to CaO with respect to destroying the $SiO_4$ network structure by addition of extra oxygen. However, $TiO_2$, like $CaF_2$, effectively dissolves CaO (the primary "network destroyer") and hence renders the fluidization more rapid by homogeneous distribution of CaO to the chain or network structure.

In a first trial under this invention, the standard fluidizing additive of 40 lbs. of fluorspar for a metal charge of 3600 lbs., was displaced by 32 lbs. of a titanium compound ($2Fe_xO_y \cdot TiO_2$). This is a compound which contains titanium dioxide and introduces the possibility that titanium may revert and enter the metal. Normally this would be undesirable in a basic operated cupola where nodular cast iron is being produced, since the presence of the titanium in the metal may affect the nodular metal quality and structure. However, in the production of grey cast iron, typically from an acid operated cupola, it has been discovered that controlled and predictable quantities of titanium in the metal are desirable from the standpoint of providing an improved chill factor for low carbon equivalent irons. The most beneficial aspect of the titanium compound is the low bulk cost factor which is 4 to 5 times cheaper than fluorspar and has proven to be equally as effective in fluidizing the slag composition.

The replacement of fluorspar with the titanium compound was gradual and was carried out over an extended period of time. The charge to the specific cupola was 575 lbs. of coke, 50 lbs. of limestone, 3,600 lbs. of metal (350 lbs. of shredded scrap, 1,575 lbs. of loose scrap, 450 lbs. of borings, 1,125 lbs. of castings) and 100 lbs. of silicon briquettes.

Observations indicated there was no significant difference in melt control utilizing the substituted fluidizing agent but, most significantly, the metal with the low carbon equivalent (4.09) exhibited low chill in a wedge test. This has now been confirmed to be attributed to the presence of titanium which has a maximum graphitizing effect at 0.08 weight percent. The titanium analysis in the metal resulting from such trial ranged from 0.02–0.08 weight percent. The average titanium content for the metal produced with a slag having the titanium compound as the only fluidizing material was 0.06 weight percent. Slag viscosity was adequate and the ratio of the percentage of titanium compound in the charge to the percentage of titanium compound in the metal was approximately 15:1. It further appeared that the ratio of titanium dioxide in the slag to titanium in the metal was about 47:1. The presence of titanium revealed a potential for more ferrosilicon inoculant reduction in achieving the chill control earlier referred to.

A chill test employs a standard W2 wedge block as per ASTM A367–60. "Chill" in grey iron is actually the formation of hard iron or alloy iron carbides (white iron) within the metal structure. The following factors can influence chill:

a. low carbon or silicon content (or low carbon equivalent)
b. high carbide stabilizer content (Cr, Mo, Mn)
c. high sulfur content
d. high gas content
e. low pouring temperature in conjunction with above factors The formation of chill or carbides presents major machining difficulties because of very high localized hardness, especially in thin sections.

The wedge sample is fractured; the depth of chill or white iron, or carbide formation, which is easily distinguished from the normal grey iron facture, is measured from the tip of the wedge to the transition zone. This depth is reported in 32's of an inch and is referred to as the chill factor; chill depth is controlled within specific operating limits for metal quality control considerations.

Several other trials were run to corroborate the ability of the titanium compound substitution for fluorspar and yet achieve equivalent fluidity in an acid cupola operation. In one, limestone was increased from 50 lbs. to 75 lbs. in the middle of the trial in order to assess the affect of increased basicity on slag fluidity. It was observed that no apparent difference in slag properties resulted. The slag analysis for this one trial contained: 30–42% CaO, 0.5–4% $TiO_2$, 41–44% $SiO_2$, 7–15% $Al_2O_3$, 1.6–3.2% MnO, and less than 1% sulfur.

I claim as my invention:

1. A method of fluxing and fluidizing a slag in an acid operated cupola, to produce grey cast iron by adding to the cupola charge an effective amount of fluxing composition comprising, by weight relative to the metal charge, from 1.5–3.5% limestone or dolomitic limestone and 0.5–1.5% $2Fe_xO_y \cdot TiO_2$.

2. The method as in claim 1, in which the fluxing composition is varied in an amount to provide a controlled reversion of the titanium compound to titanium in the resultant grey cast iron at low carbon equivalent and thereby provide a limited chill factor.

3. The method as in claim 1, in which said fluxing composition has said $2Fe_xO_y \cdot TiO_2$ limited in an amount to 0.5–1.1% of the total metal charge to said cupola.

4. In a method of fluxing and fluidizing a slag in an acid operated cupola as in claim 1, which further includes the addition of fused soda ash for a portion of said $2Fe_xO_y \cdot TiO_2$ so that the resulting slag contains 0.2–3.0% $Na_2O$.

* * * * *